US006619364B1

(12) United States Patent
Ehrlich et al.

(10) Patent No.: US 6,619,364 B1
(45) Date of Patent: Sep. 16, 2003

(54) PORTABLE CUBICLE SCREEN

(75) Inventors: Mary Van Ehrlich, Atlanta, GA (US); Stanley M. Ferrell, Roswell, GA (US); La Veria Baker, Lithonia, GA (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 09/963,484

(22) Filed: Sep. 27, 2001

(51) Int. Cl.[7] ..... A47G 5/00

(52) U.S. Cl. ..... 160/135; 160/84.01; 160/84.03; 16/94 R

(58) Field of Search ..... 160/135, 84.01, 160/84.03, 84.06, 370.21, 370.22, 370.23; 16/94 R, 90

(56) References Cited

U.S. PATENT DOCUMENTS 3,575,407 A * 4/1971 Carson ..... 269/322
3,729,109 A * 4/1973 McCurdy ..... 248/487
3,797,005 A * 3/1974 Schwartz ..... 340/274
3,850,223 A * 11/1974 Tompkins ..... 160/84 R
3,874,716 A * 4/1975 Bancroft ..... 292/175
3,987,863 A * 10/1976 Mittendorf et al. ..... 180/68 P
4,081,880 A * 4/1978 Edeus ..... 16/90
4,083,395 A * 4/1978 Romano ..... 160/84 R
4,344,206 A * 8/1982 Hermanson ..... 16/94 R
4,859,052 A * 8/1989 McFarland et al. ..... 351/239
4,865,106 A * 9/1989 Wichelman ..... 160/84.1
5,230,180 A * 7/1993 Tweedt et al. ..... 49/400
5,364,311 A * 11/1994 Chou ..... 472/62
5,450,694 A * 9/1995 Goranson et al. ..... 52/71
5,611,384 A * 3/1997 Carter ..... 160/135
5,787,956 A * 8/1998 Chen ..... 160/370.23
5,937,929 A * 8/1999 Chen ..... 160/370.23
6,009,930 A * 1/2000 Jantschek ..... 160/135
6,059,007 A * 5/2000 Tomita ..... 160/242
6,082,431 A * 7/2000 Decola ..... 160/209
6,135,193 A * 10/2000 Lloyd ..... 160/370.23
6,176,042 B1 * 1/2001 Rossman et al. ..... 49/463
6,202,732 B1 * 3/2001 Chen ..... 160/370.23
6,293,328 B1 * 9/2001 Fremont ..... 160/135
6,378,592 B1 * 4/2002 Kimmet ..... 160/84.04

FOREIGN PATENT DOCUMENTS

GB 2353315 * 2/2001

* cited by examiner

*Primary Examiner*—Bruce A. Lev
(74) *Attorney, Agent, or Firm*—Shaw Pittman LLP

(57) ABSTRACT

A portable screen or door for a cubicle system. The screen is collapsible and extendible and includes a temporary mounting system. The temporary mounting system permits easy installation and removal of the screen and permits installation and removal without noticeable harm to the cubicle. The screen can be used either alone or in combination with a mounting bracket that also includes a temporary mounting system.

7 Claims, 9 Drawing Sheets

PORTABLE CUBICLE SCREEN

BACKGROUND

1. Field of the Invention

The present invention relates generally to a screen or to a door, more particularly, to a screen or to a door for use with a cubicle.

2. Background of the Invention

Many modern offices have resorted to the use of cubicles. Cubicles provide a modular furniture system that is relatively easy and inexpensive to install, configure and re-configure. Cubicles also provide efficient use of floor space. However, cubicle systems also have certain drawbacks. One of the drawbacks is the lack of privacy.

Installing conventional doors to cubicle openings are generally not feasible. First, conventional doors would require a large swing area in order to operate. In other words, the sweep required to allow the door to open would require the door to swing either inwards or outwards a distance equal to the width of the door. The movement of a door in an arc equal to its width is often not possible because of interference with other items, such as a desk, a filing cabinet, or hallway traffic.

Doors are also impractical to install because cubicles must retain their modular configuration. If a certain cubicle element includes a door, then that element is no longer modular, but becomes a specialized door unit. To keep track of specialized units and to modify the construction and installation of a cubicle system due to specialized elements eliminates an important benefit of modular cubicle systems.

SUMMARY OF THE INVENTION

The present invention is directed to a screen or a door adapted to be associated to a cubicle. The screen is intended to be collapsible and extendible and also includes a temporary mounting system disposed on its outer portions. The temporary mounting system permits easy installation and removal of the screen without causing noticeable damage to the cubicle system. In some embodiments, the screen is self-supporting and can retain its vertical position without the use of a curtain rod or other horizontal support.

Some embodiments of the present invention include a mounting bracket adapted to associate the screen with a portion of the cubicle. The mounting bracket includes a mounting portion that is adapted to engage the screen and help support the screen. The mounting bracket can include an array of optional accessories. The mounting bracket is also designed to be associated with the cubicle system by the use of a temporary mounting system.

Additional features and advantages of the invention will be set forth in the description which follows, and in part will be apparent from the description, or may be learned by practice of the invention. The objectives and advantages of the invention will be realized and attained by the structure and steps particularly pointed out in the written description, the claims and the drawings.

DETAILED DESCRIPTION OF THE INVENTION

Figure 1:
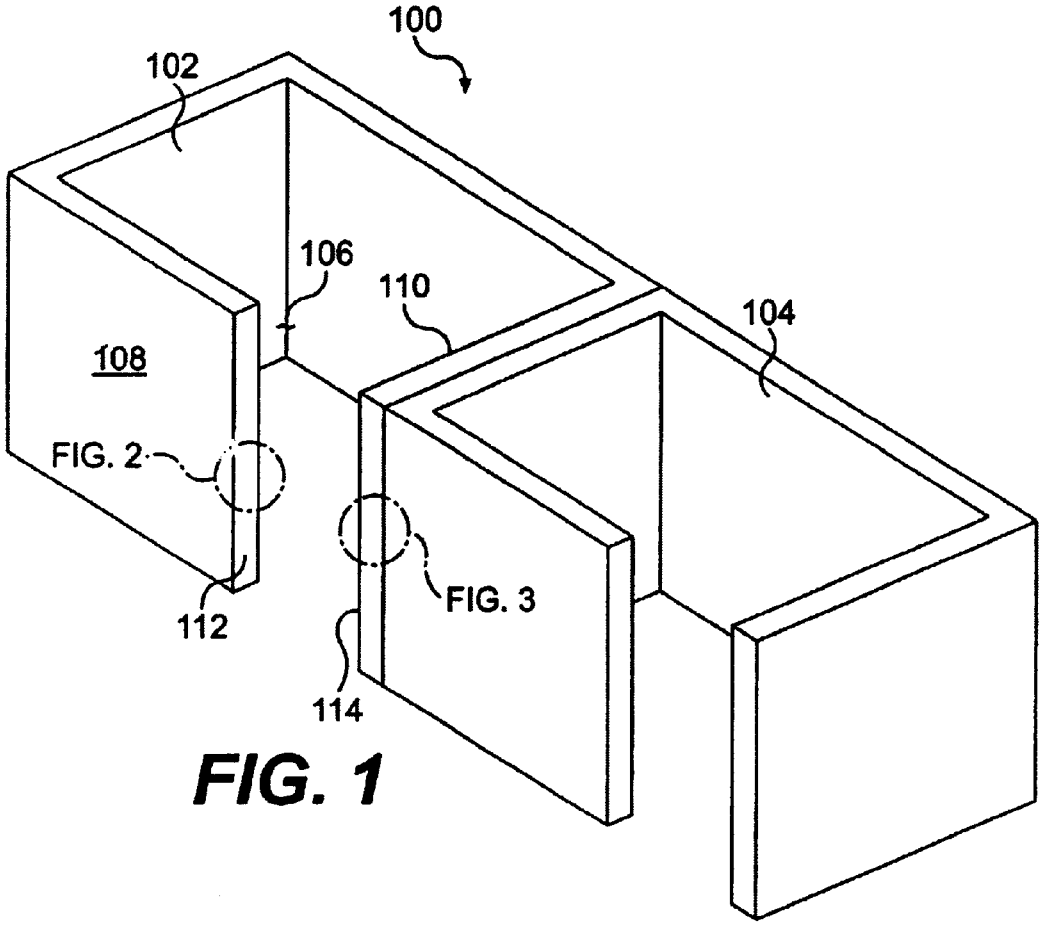
FIG. 1 is an isometric view of a cubicle system.

FIG. 1 shows a cubicle system 100. A first cubicle 102 is joined to a second cubicle 104. First cubicle 102 includes an opening 106. Opening 106 is formed by a gap between a first wall 108 and a second wall 110 of first cubicle 102. Cubicles are generally made of modular sections and those modular sections are generally constructed similarly.

Figure 2:
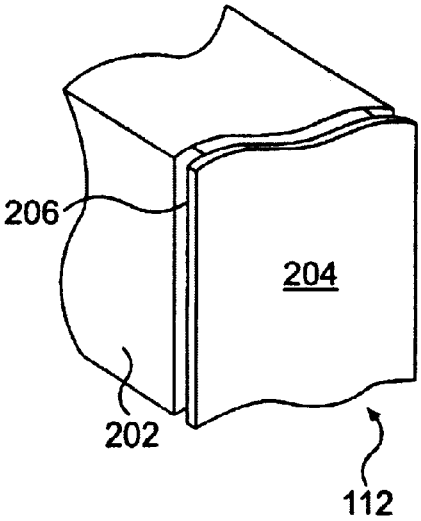
FIG. 2 is an enlarged isometric view of an end of a cubicle wall.

FIG. 2 shows an enlarged view of a first end 112 of opening 106. Generally, most cubicle systems, including the cubicle shown in FIG. 2, include a wall structure with a panel 202 and end 204. Generally, end 204 is made of metal and panel 202 is made of a laminate or cloth. A slot 206 disposed between panel 202 and end 204 includes a series of slots (not shown) that are used to support shelving, cabinets, writing surfaces, and other items designed to be mounted to the cubicle wall.

Figure 3:
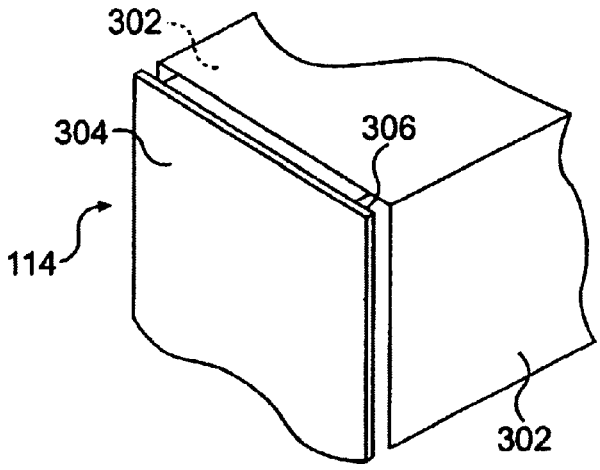
FIG. 3 is an enlarged isometric view of an end of a cubicle wall.

FIG. 3 shows an enlarged view of a second end 114 of opening 106. Similar to first end 112, second end 114 also has a wall structure with a panel 302 and end 304. Generally, end 304 is made of metal and panel 302 is made of a laminate or cloth. A slot 306 disposed between panel 302 and end 304 includes a series of slots (not shown) that are used to support shelving, cabinets, writing surfaces, and other items designed to be mounted to the cubicle wall.

In the configuration shown in FIG. 1, first wall 108 is defined by end 204 and second wall 110 is defined by panel 302. In other words, end 204 faces panel 302. It is of course possible that opening 106 is defined by two ends or two panels or one end and one panel, as shown in FIG. 1.

In accordance with the present invention, a door or screen is disposed across opening 106. FIGS. 4–7 show schematic diagrams of various embodiments of the present invention. As shown in those Figures, various different types of screen configurations can be disposed within various different types of openings defined by different ends.

Figure 4:
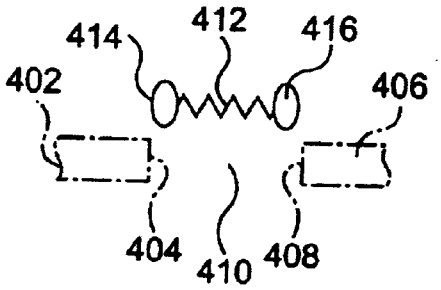
FIG. 4 is a schematic diagram of a preferred embodiment of a screen in accordance with the present invention.

Referring to FIG. 4, a first wall 402 having a first end 404 and a second wall 406 having a second end 408 define an opening 410. A screen 412 is disposed in opening 410 between first end 404 and second end 408. Preferably, screen 412 is attached to both first end 404 and second end 408 in a manner that permits easy installation and removal of the screen 412. In the embodiment shown, a first temporary attachment system 414 is used to associate screen 412 with first end 404 and a second temporary attachment system 416 is used to associate screen 412 with second end 408. Preferably, this temporary attachment system facilitates easy removal and installation of screen 412 without causing significant damage to either first wall 402 or second wall 406 and without the need to significantly alter or modify either first wall 402 or second wall 406. In exemplary embodiments, temporary attachment systems permit the installation and removal of screen 412 without the use of tools. Screen 412 is preferably an accordion type screen as depicted in FIG. 4.

Figure 5:
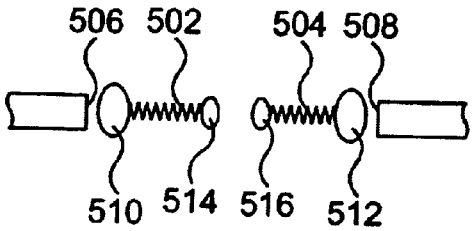
FIG. 5 is a schematic diagram of a preferred embodiment of a screen in accordance with the present invention.

FIG. 5 shows an embodiment where two screens, first screen 502 and second screen 504 are disposed between first end 506 and second end 508. In this embodiment, screen 502 is associated with first end 506 by a first temporary attachment system 510 and second screen 504 is associated with second end 508 by a second temporary attachment system 512.

First screen 502 and second screen 504 are designed to meet at a point between first end 506 and second end 508. Preferably, first and second screens 502 and 504, respectively, are of equal size and the two screens meet at a center point between first end 506 and second end 508, but this is not necessary and first screen 502 could be larger or smaller than second screen 504 and the two screens could meet at a point other than the center point.

First screen 502 preferably includes a third temporary attachment system 514 and second screen 504 preferably includes a fourth temporary attachment system 516. Third and fourth temporary attachment systems, 514 and 516, respectively, are used to associate first screen 502 with second screen 504 at a point between first end 506 and second end 508. Using two screens 502 and 504 and four temporary attachment systems 510, 512, 514 and 516, this embodiment provides a screen with a double screen and a central opening.

For convenience, the embodiment shown in FIG. 4 will be referred to as a single screen embodiment and the embodiment shown in FIG. 5 will be referred to as a double screen embodiment. The embodiments shown in FIG. 4 and FIG. 5 are embodiments where the screen is disposed between two ends of a cubicle wall. Recall that an end 204 (see FIG. 2) of a cubicle wall is the metal end and recall that end 204 is different from panel 202 (see FIG. 2). As shown in the embodiments that follow, both single or double screen devices can be disposed within openings defined by either ends or panels or both.

Figure 6:
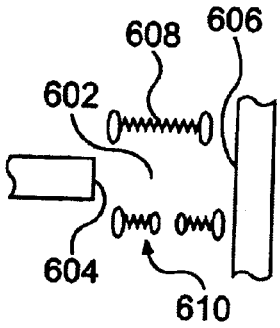
FIG. 6 is a schematic diagram of a preferred embodiment of a screen in accordance with the present invention.

FIG. 6 shows schematically, a configuration in which an opening 602 is defined by an end 604 and a panel 606. A single screen embodiment 608 with suitable temporary attachment systems can be disposed within opening 602. Alternatively, if desired, a double screen embodiment 610 with suitable attachment systems could also be disposed within opening 602.

Figure 7:
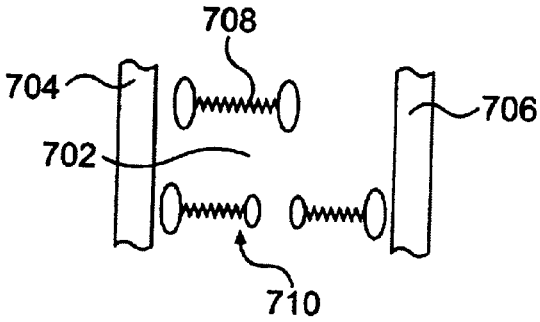
FIG. 7 is a schematic diagram of a preferred embodiment of a screen in accordance with the present invention.

FIG. 7 shows schematically, a configuration in which an opening 702 is defined by a first panel 704 and a second panel 706. A single screen embodiment 708 with suitable temporary attachment systems can be disposed within opening 702. Alternatively, if desired, a double screen embodiment 710 including suitable attachment systems could also be disposed within opening 702.

FIGS. 4–7 show examples of various optional mounting arrangements. Preferred embodiments of screens according to the present invention can be mounted and used in many other configurations between many other types of openings defined by different many different structures.

Some examples of suitable temporary attachment systems include magnets, A hook and loop fasteners like Velcro®, releasable adhesives, pins, brackets, other mechanical fasteners, and deformable fasteners like clips. Various examples of preferred temporary attachment systems are discussed in greater detail below.

Figure 8:
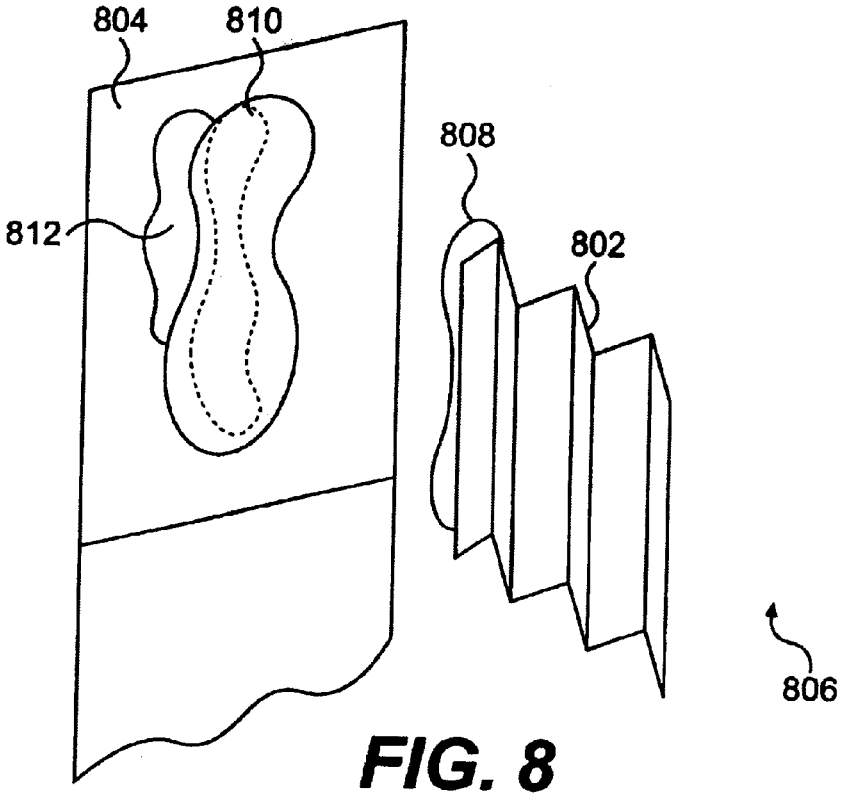
FIG. 8 is an isometric view of a generalized embodiment of a screen in accordance with the present invention.

FIG. 8 shows a generalized case where a screen 802 is associated with one side 804 of an opening 806. In this case, side 804 could be either an end 204 (see FIG. 2) or a panel 202 (see FIG. 2). There are two options for mounting screen 802 to side 804.

The first option would be to associate screen 802 with side 804 using a temporary mounting system 808 that is permanently attached to screen 802. Temporary mounting system 808 would then be used to associate screen 802 with side 804.

A second option would be to use a mounting bracket 810. In this case, mounting bracket 810 would be associated with side 804 using a temporary mounting system 812. Screen 802 would be associated with mounting bracket 810 using either a temporary mounting system 808 or a permanent mounting system where screen 802 is permanently attached to mounting bracket 810. As embodiments of the invention are discussed, it should be kept in mind that screen 802 can be associated with mounting bracket 810 either temporarily or permanently.

Figure 9:
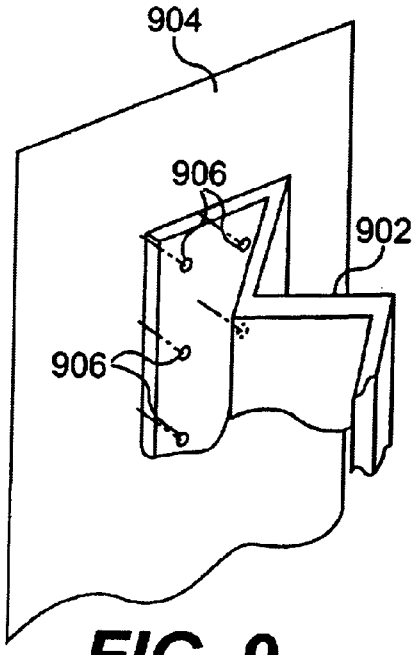
FIG. 9 is an isometric view of a preferred embodiment of a screen engaging a mounting bracket in accordance with the present invention.

FIG. 9 shows an embodiment of the present invention in which screen 902 is directly associated with side 904. In this case, side 904 is a cloth panel, and a plurality of pins 906 mounted to screen 902 are used to associate screen 902 to side 904. Pins 906 would not cause permanent damage to side 904 and pins 906 permit the easy installation and removal of screen 902.

Figure 10:
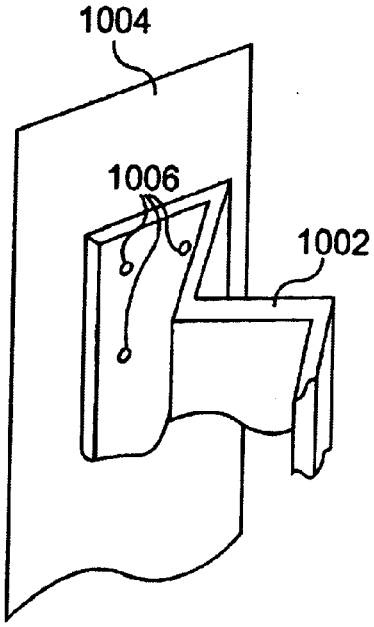
FIG. 10 is an isometric view of a preferred embodiment of a screen engaging a mounting bracket in accordance with the present invention.

FIG. 10 shows an embodiment of the present invention where screen 1002 is directly associated with side 1004. In this case, side 1004 is a metal end, similar to end 204 (see FIG. 2), and a plurality of magnets 1006 mounted to screen 1002 are used to associate screen 1002 to side 1004.

Magnets 1006 would not cause permanent damage to side 1004 and magnets 1006 permit the easy installation and removal of screen 1002.

Figure 11A:
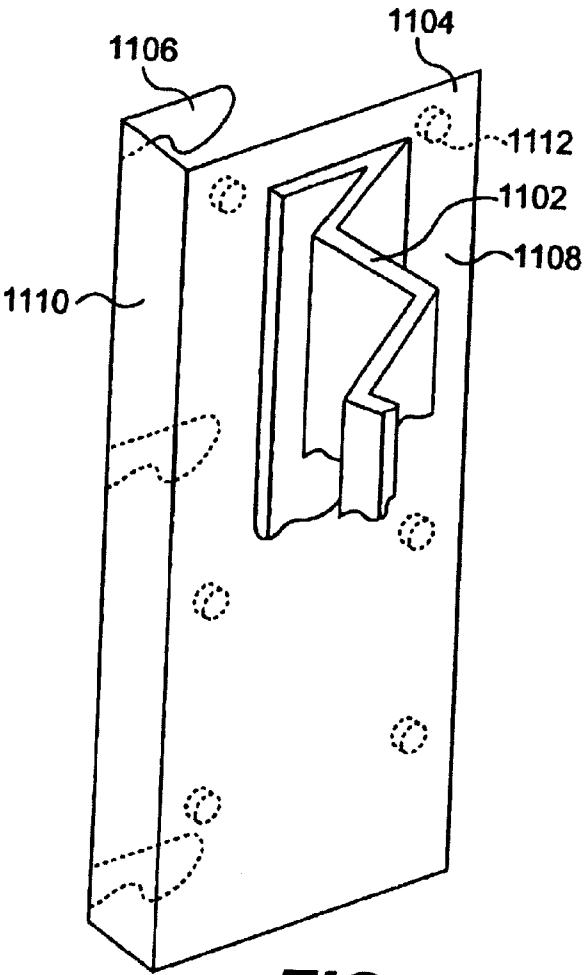
FIG. 11A is an isometric view of a preferred embodiment of a mounting bracket in accordance with the present invention.
Figure 11B:
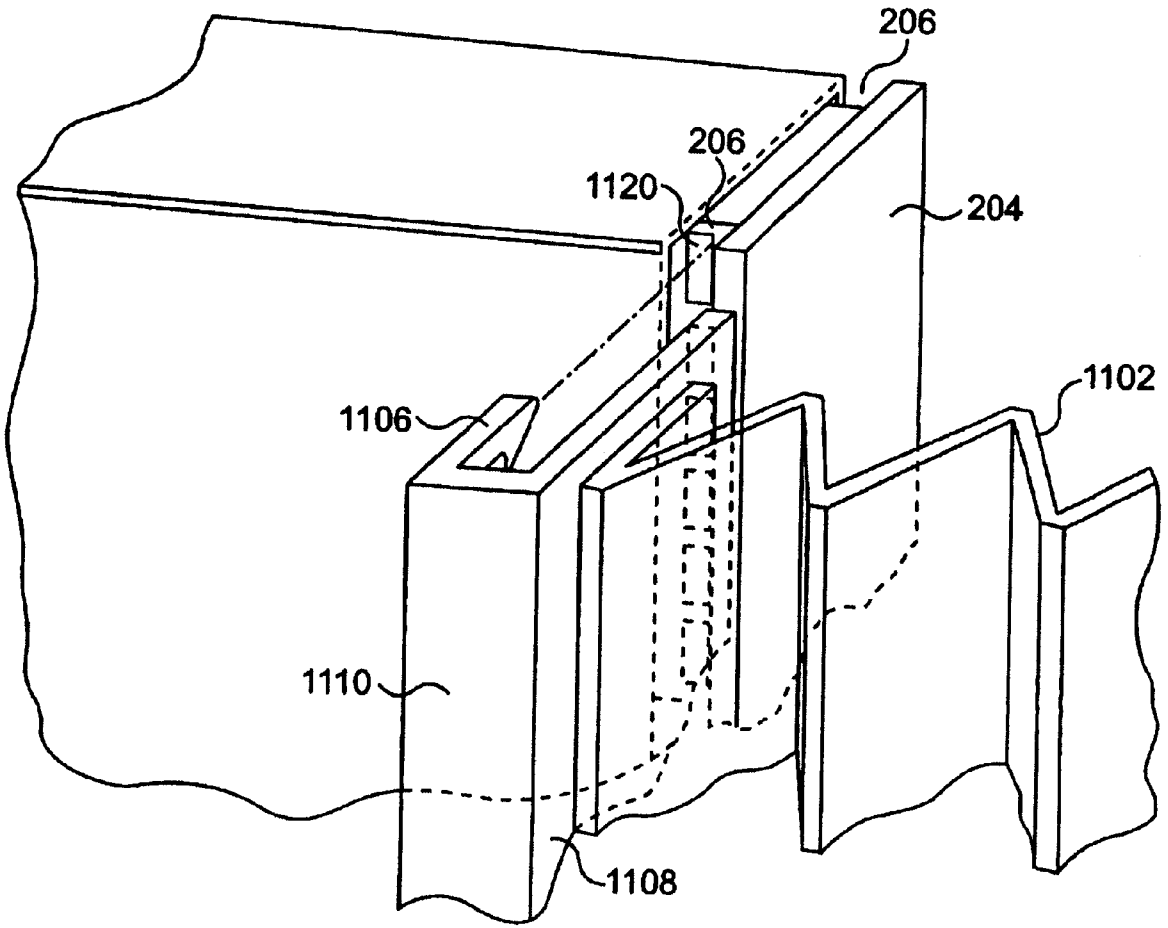
FIG. 11B is an enlarged isometric view of a preferred embodiment of a mounting bracket in accordance with the present invention
Figure 11C:
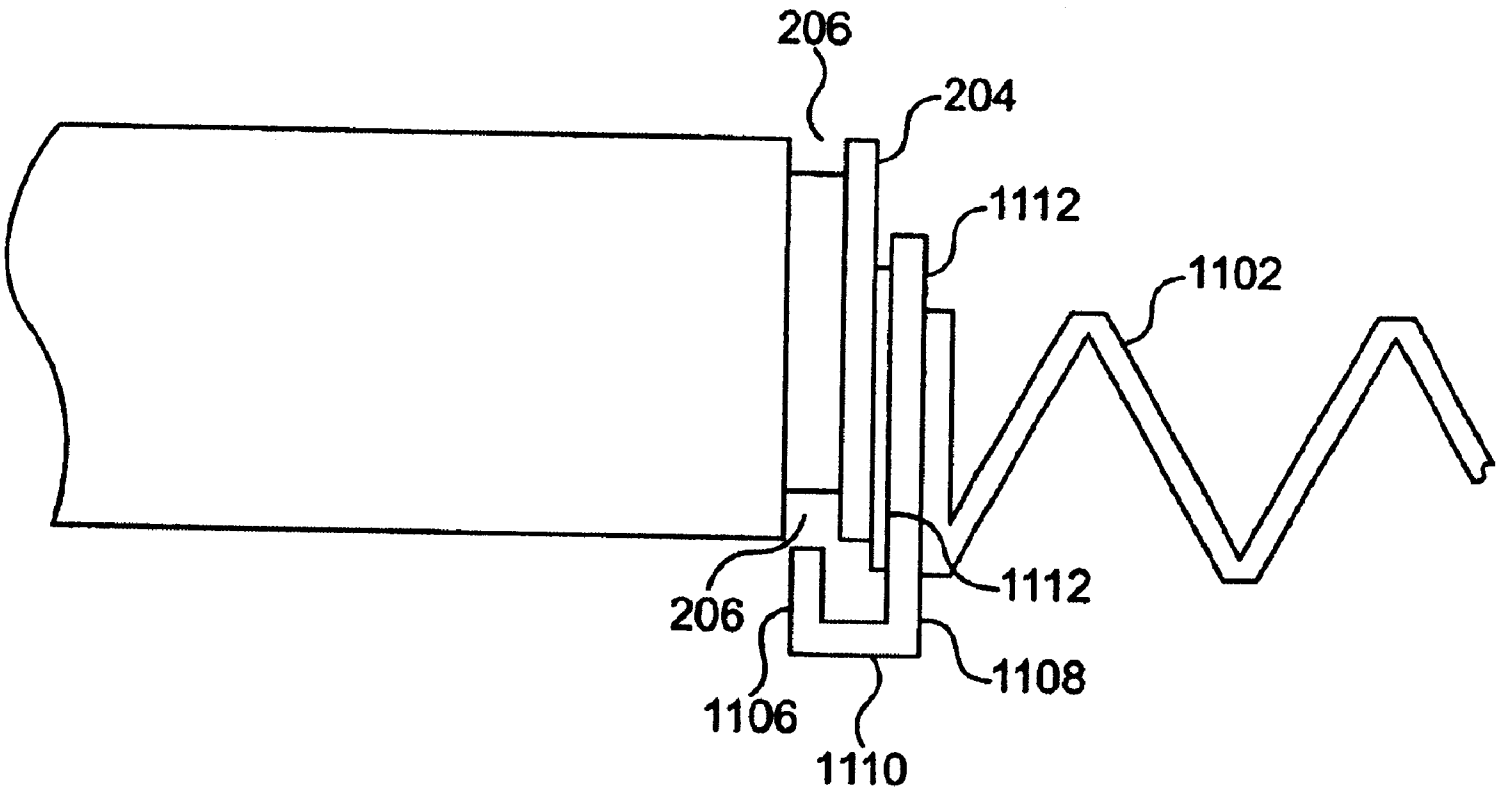
FIG. 11C is a top view of a preferred embodiment of a mounting bracket in accordance with the present invention

FIGS. 11A–11C show an embodiment where screen 1102 is associated with a mounting bracket 1104. Screen 1102 can be permanently attached to mounting bracket 1104 or screen 1102 can be associated with mounting bracket 1104 by the use of a temporary mounting system. Mounting bracket 1104 includes provisions that assist in associating mounting bracket 1104 with a cubicle end 204. Mounting bracket 1104 includes a mounting portion 1108 that is designed to retain and hold screen 1102 on a first side.

Mounting bracket 1104 includes an end wall 1110 that wraps around a corner of cubicle end 204 (see FIG. 2) and provides a location where at least one tab 1106 can extend in a direction generally parallel to mounting portion 1108 and towards a cubicle wall. This arrangement permits tab 1106 to engage slots 1120 disposed in a slot 206. As an option, magnets 1112 could also be provided on a second side of mounting portion 1108. Magnets 1112 would engage the cubicle end 204 and would provide additional support.

Figure 12:
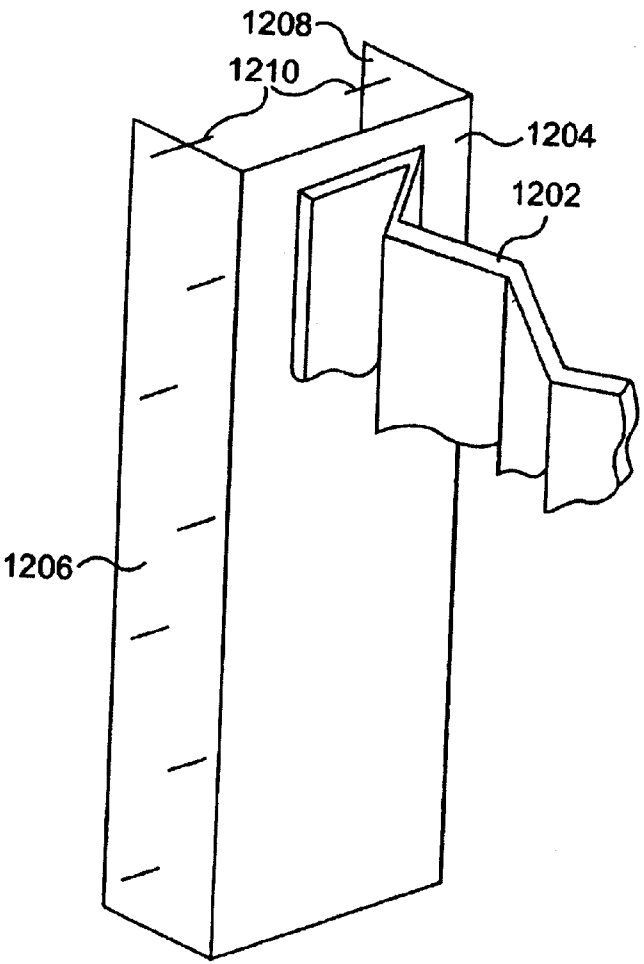
FIG. 12 is an isometric view of a preferred embodiment of a mounting bracket in accordance with the present invention.

Another embodiment that uses a mounting bracket is shown in FIG. 12. A screen 1202 is associated with a mounting bracket 1204. Screen 1202 can be permanently attached to mounting bracket 1204 or screen 1202 can be associated with mounting bracket 1204 by the use of a temporary mounting system. In this embodiment, at least one side wall 1206, and preferably a pair of side walls 1206 and 1208, are used to attach mounting bracket 1204 to a cubicle. At least one pin 1210 disposed on either or both side walls 1206 and 1208 is used to assist in attaching mounting bracket 1204 to the cubicle. Preferably, mounting bracket 1204 is attached to an end of a cubicle wall and pins 1210 engage the cloth panels of the cubicle wall.

Figure 13:
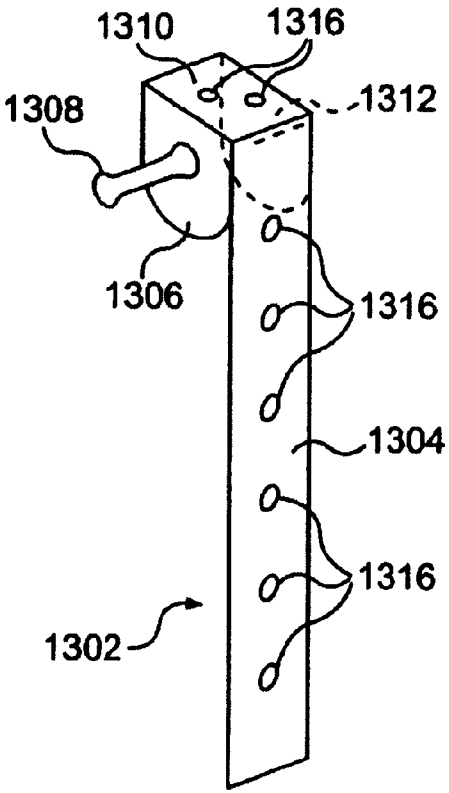
FIG. 13 is an isometric view of a preferred embodiment of a mounting bracket in accordance with the present invention.

In addition to providing a mounting surface for screens, mounting brackets can include other features as well. FIG. 13 shows an embodiment where mounting bracket 1302 includes a mounting portion 1304 that is adapted to receive a screen. Mounting bracket 1302 also includes an interior portion 1306 that is designed to face the interior of a cubicle. Interior portion 1306 can include a hook 1308 that can be used to hold coats, clothes, and other hanging items. Hook 1308 could also be shaped like a hat peg, as shown in FIG. 13. Optionally, mounting bracket 1302 can include an upper support 1310 and an outer support 1312. Upper support 1310 and outer support 1312 can be used to provide additional vertical and horizontal support to mounting bracket 1302.

As an option, all of the surfaces that face a metallic portion of the cubicle can include magnets 1316. Magnets 1316 would engage the cubicle at various locations and would provide additional support.

Figure 14:
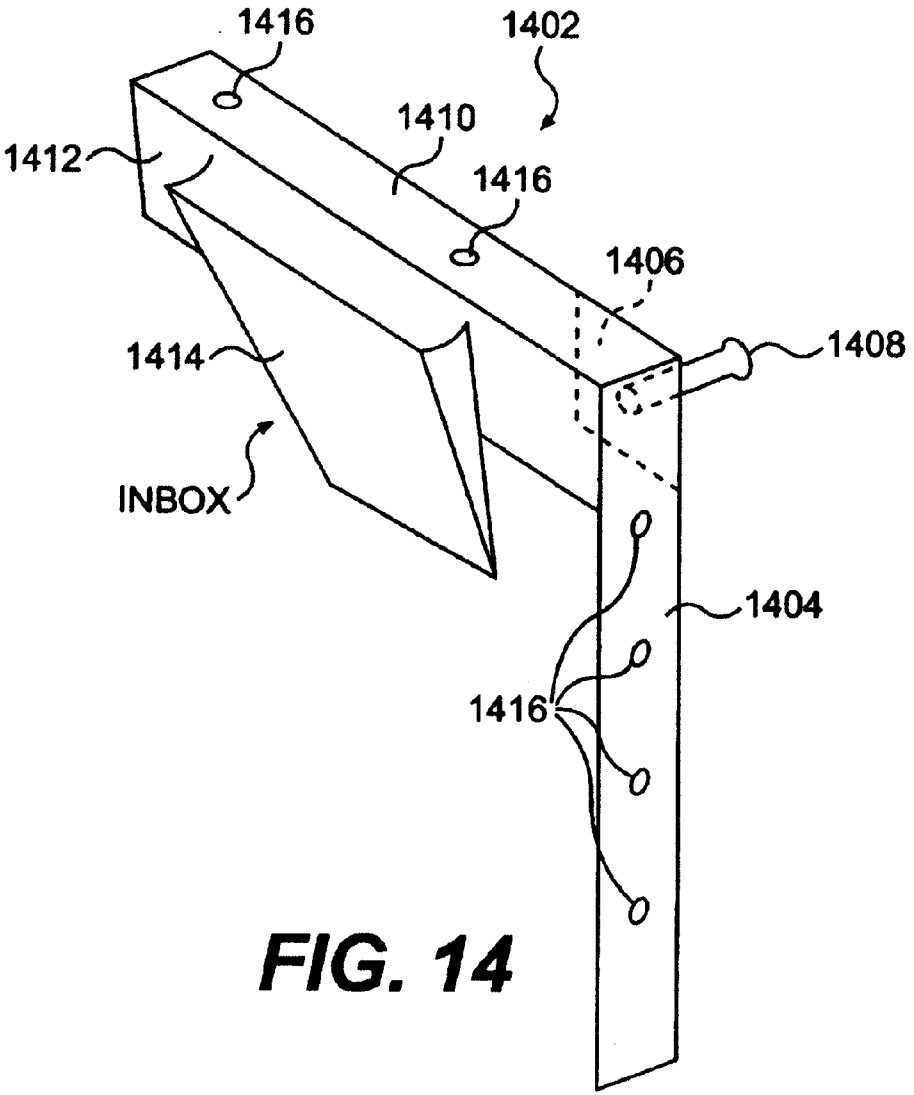
FIG. 14 is an isometric view of a preferred embodiment of a mounting bracket in accordance with the present invention.

FIG. 14 is another embodiment of a mounting bracket 1402 that includes additional features. Mounting bracket 1402 includes a mounting portion 1404 that is adapted to receive a screen. Mounting bracket 1402 also includes an interior portion 1406 that is designed to face the interior of a cubicle. Interior portion 1406 can include a hook 1408 that can be used to hold coats, clothes, and other hanging items. Hook 1408 could also be shaped like a hat peg, as shown in FIG. 14. Mounting bracket 1402 includes an upper support 1410 and an outer support 1412. Upper support 1410 and outer support 1412 can be used to provide additional vertical and horizontal support to mounting bracket 1402. Optionally, a paper tray 1414 may be attached to either upper support 1410 or outer support 1412. While any kind of paper tray may be used, preferably, paper tray 1414 is a vertical paper tray as shown in FIG. 14. Paper tray 1414 could be used as an "In Box."

As an option, all of the surfaces that face a metallic portion of the cubicle can include magnets 1416. Magnets 1416 would engage the cubicle at various locations and would provide additional support.

Figure 15:
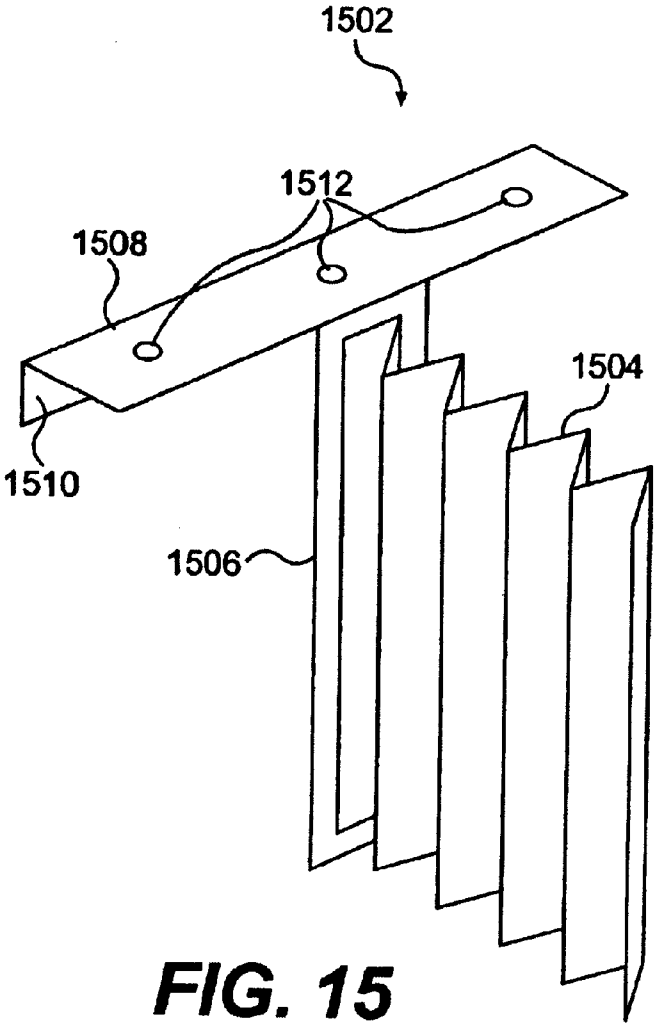
FIG. 15 is an isometric view of a preferred embodiment of a mounting bracket in accordance with the present invention.

FIG. 15 is an embodiment of a mounting bracket 1502 that would be used to provide a screen 1504 across a cubicle panel as opposed to an end. Mounting bracket 1502 includes a mounting portion 1506 that is adapted to receive a screen. Mounting bracket 1502 also includes an upper portion 1508 that is designed to face the top of a cubicle. Mounting bracket 1502 can optionally include an outer portion 1510 that is designed to engage the opposite side of cubicle wall as mounting portion 1506.

As an option, all of the surfaces that face a metallic portion of the cubicle can include magnets 1512. Magnets 1512 would engage the cubicle at various locations and would provide additional support.

Figure 16:
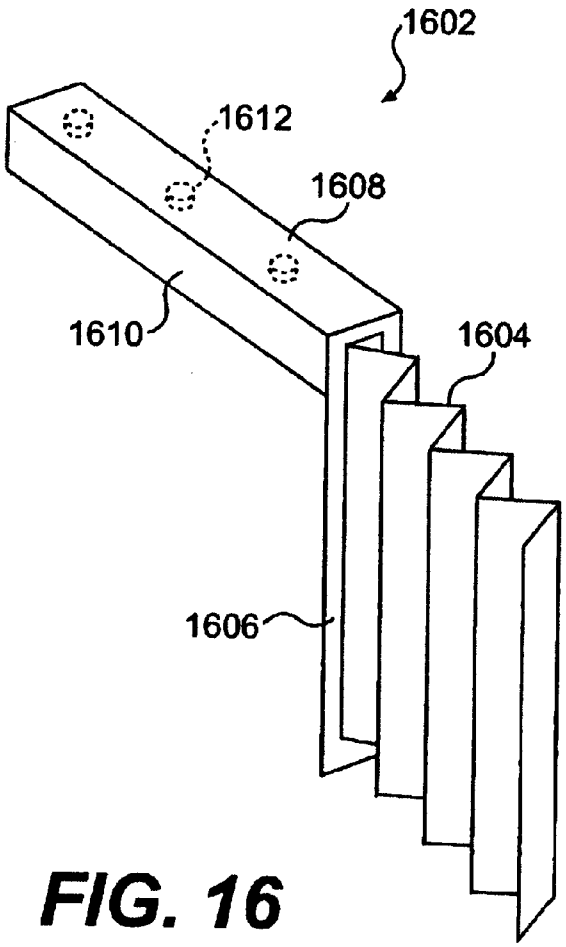
FIG. 16. is an isometric view of a preferred embodiment of a mounting bracket in accordance with the present invention.

FIG. 16 is another embodiment of a mounting bracket 1602. A mounting portion 1606 is adapted to receive a screen 1604. Mounting bracket 1602 also includes an upper portion 1608 that is designed to engage the top of a cubicle. Mounting bracket 1602 can optionally include an outer portion 1610 that is designed to engage a side of cubicle wall that is perpendicular to both the top of the cubicle and the end of the cubicle. This embodiment can be used where the top of a cubicle is available, but other portions of the cubicle do not provide a convenient location to receive a mounting device.

As an option, all of the surfaces that face a metallic portion of the cubicle can include magnets 1612. Magnets 1612 would engage the cubicle at various locations and would provide additional support.

Figure 17:
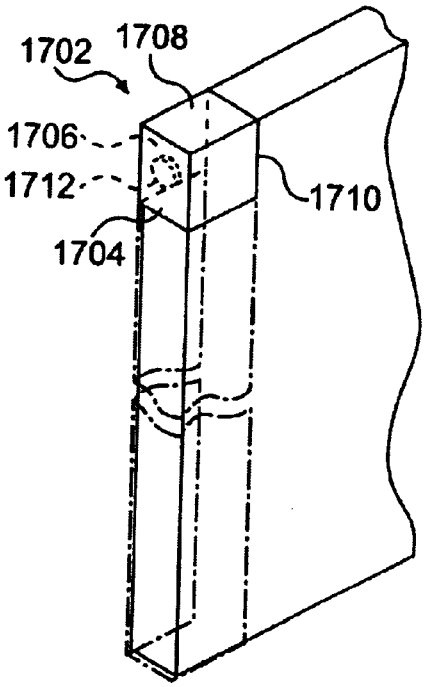
FIG. 17 is an isometric view of a preferred embodiment of a strike plate in accordance with the present invention.

FIG. 17 shows an embodiment of a strike plate 1702. Strike plate 1702 is designed to be associated with a cubicle wall and to act as an engaging member for a screen. Preferably, the screen includes provisions that permit one end of the screen to engage strike plate 1702.

In the embodiment shown in FIG. 17, strike plate 1702 includes an end portion 1704 and an inner portion 1706. Strike plate 1702 can optionally include an upper portion 1708 and an outer portion 1710. The interior surface of end portion 1704 can optionally include a magnet 1712 that assists in securing strike plate 1702 to an end of the cubicle wall. Strike plate 1702 is preferably made of a metallic material that is capable of attracting a magnet and inner portion 1706 is designed to engage a magnet attached to a screen. In this way, strike plate 1702 can assist in retaining the screen in the closed or extended position.

Any of the mounting brackets could be used as strike plates. A strike plate would be disposed opposite the mounting location of the screen and would provide a surface that would be used by provisions associated with the screen to retain the screen in the closed position.

The screens shown in the various embodiments are designed to be self-supporting. Self-supporting means that the screen has enough internal structure and rigidity so that the screen can support its own weight as well as the weight of other items attached to the screen without the use of a curtain rod or any other supporting member disposed above the screen. In other words, a self-supporting screen can be cantilever mounted so that when first side is attached to a generally rigid structure, the screen can be extended horizontally to its designed extension limit and the second end of the screen would remain in roughly the same vertical position as the first end. Preferably, the screens contemplated for use with the present invention are collapsible.

Figure 18:
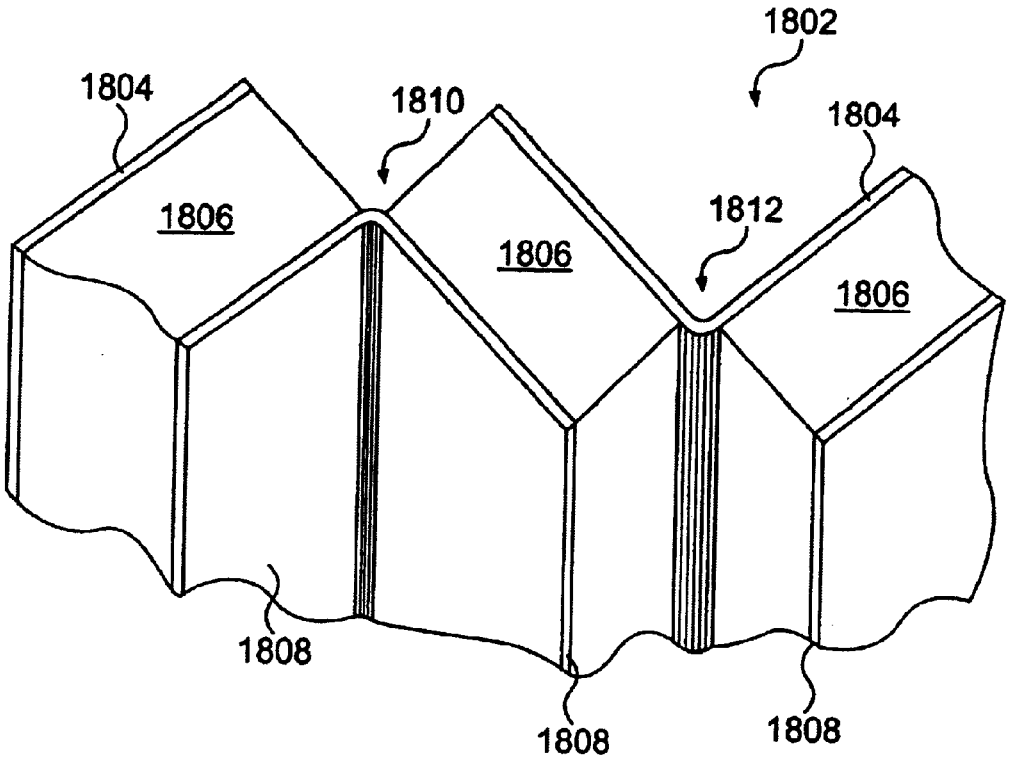
FIG. 18 is an isometric view of a preferred embodiment of a screen in accordance with the present invention.

FIG. 18 has been greatly enlarged and distorted to show hinge details. Screen 1802 is made of a composite material that includes three layers, a first resilient layer 1804, a second substrate layer 1806, and a third resilient layer 1808. In order to make a first bend 1810, the first resilient layer 1804 and the substrate layer 1806 are cut leaving the third resilient layer 1808 intact. This arrangement permits the first resilient layer 1804 and the substrate layer 1806 to bend about third resilient layer 1808. In first bend 1810, third resilient layer 1808 acts as a live hinge throughout the vertical length of screen 1802. A "live hinge" is a mechanism that behaves like a hinge without actually requiring a hinge.

The second bend 1812 is produced in a similar manner except the third resilient layer 1808 and substrate layer 1806 are cut leaving first resilient layer 1804 intact. With this arrangement, third resilient layer 1808 and substrate layer 1806 can rotate about first resilient layer 1804 and first resilient layer 1804 acts as a live hinge. In one embodiment, screen 1802 is made of a foam core material.

Figure 19:
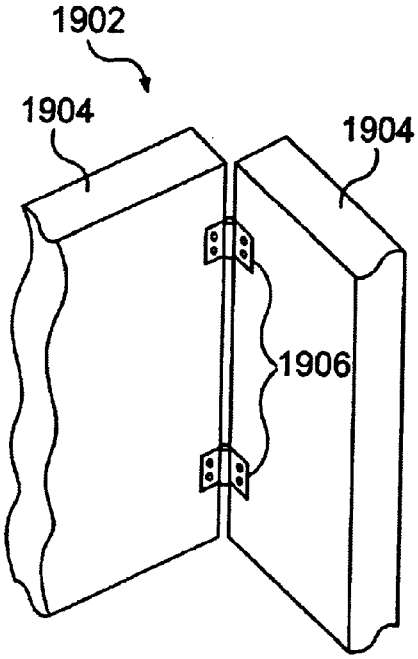
FIG. 19 is an isometric view of a preferred embodiment of a screen in accordance with the present invention.

In another embodiment, shown in FIG. 19, screen 1902 is made of a series of rigid members 1904 joined by one or more hinges 1906. Hinges 1906 permit the screen to extend and collapse to a non-use position. For clarity, FIG. 19 shows only a single joint between two rigid members. Clearly, one or more of these types of joints could be used to construct screen 1902. In other words, screen 1902 could include two, three or more rigid members 1904 attached in series to form screen 1902.

Figure 20:
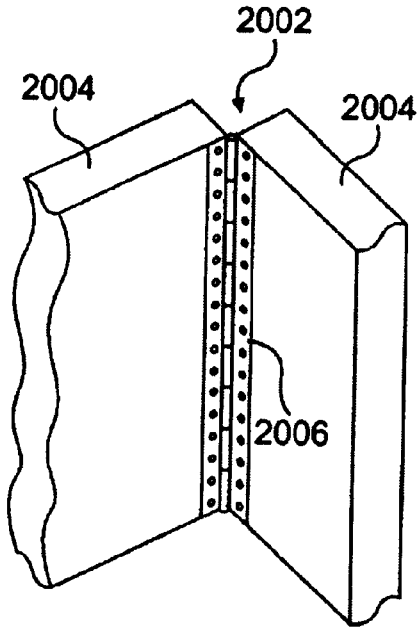
FIG. 20 is an isometric view of a preferred embodiment of a screen in accordance with the present invention.

FIG. 20 shows another embodiment where a screen is made of a series of rigid members 2004 and a single piano hinge 2006 is used to join adjacent rigid members 2004. For clarity, FIG. 20 shows only a single joint between two rigid members. Clearly, one or more of these types of joints could be used to construct screen 2002. In other words, screen 2002 could include two, three or more rigid members 2004 attached in series to form screen 2002.

The foregoing disclosure of the preferred embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A screen adapted to be associated to a cubicle comprising:

a first outer portion, a central portion and a second outer portion wherein the first outer portion is disposed horizontally outward of the central portion in a first direction and the second outer portion is disposed horizontally outward of the central portion in a second direction, wherein the first and second directions are different;

wherein the first outer portion has a first temporary mounting system and the second outer portion has a second temporary mounting system, each of the first temporary mounting system and the second temporary mounting system is adapted to be attached to the cubicle;

wherein the screen is made of a composite material having a first resilient layer, a second substrate layer, and a third resilient layer;

wherein the first resilient layer is formed into a first live hinge at a first joint between the first outer portion and the central portion; and wherein the third resilient layer is formed into a second live hinge at a second joint between the second outer portion and the central portion.

2. The screen according to claim 1, wherein the temporary mounting system includes a magnet.

3. The screen according to claim 1, wherein the temporary mounting system includes a pin.

4. The screen according to claim 1, wherein the screen is self supporting.

5. The screen according to claim 1, wherein the screen is made of a plurality of rigid members connected by live hinges.

6. An accordion screen comprising:

an outer portion and a central portion;

a temporary U-shape mounting system associated with the outer portion, the temporary U-shape mounting system including a first side wall and a second side wall adapted to engage a cubicle wall, and tabs adapted to engage slots disposed on the cubicle;

wherein a first pin is disposed through the first side wall and is adapted to engage the cubicle wall and a second pin is disposed through the second side wall and is adapted to engage the cubicle wall, and wherein the screen is made of a composite material having a first resilient layer, a second substrate layer and a third resilient layer, and the first resilient layer is formed into a first live hinge and the third resilient layer is formed into a second live hinge.

7. An accordion screen comprising:

an outer portion and a central portion;

a temporary U-shape mounting system associated with the outer portion, the temporary U-shape mounting system including a first side wall and a second side wall adapted to engage a cubicle wall, and tabs adapted to engage slots disposed on the cubicle;

wherein a first pin is disposed through the first side wall and is adapted to engage the cubicle wall and a second pin is disposed through the second side wall and is adapted to engage the cubicle wall, and wherein the screen includes a live hinge.

* * * * *